US008936347B2

(12) United States Patent
Sekino

(10) Patent No.: US 8,936,347 B2
(45) Date of Patent: Jan. 20, 2015

(54) DRIVING APPARATUS AND RECORDING APPARATUS

(71) Applicant: Canon Kabushiki Kaisha, Tokyo (JP)

(72) Inventor: Takeshi Sekino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/655,330

(22) Filed: Oct. 18, 2012

(65) Prior Publication Data

US 2013/0100206 A1 Apr. 25, 2013

(30) Foreign Application Priority Data

Oct. 21, 2011 (JP) ..... 2011-232049

(51) Int. Cl.
*B41J 23/00* (2006.01)
*B41J 19/20* (2006.01)

(52) U.S. Cl.
CPC ..... *B41J 19/202* (2013.01)
USPC ..... 347/37

(58) Field of Classification Search
CPC .... B41J 2/1752; B41J 2/17566; B41J 2/2103; B41J 2/17546; B41J 11/06; B41J 19/142; B41J 19/20; B41J 19/202; B41J 25/00; B41J 25/006; B41J 29/08; B41J 29/38; B41J 29/46; B41J 2/17513; B41J 2/17553
USPC ..... 347/37; 318/280, 281, 560, 561, 318/400.17, 599
See application file for complete search history.

(56) References Cited

U.S. PATENT DOCUMENTS

| | | | | |
|---|---|---|---|---|
| 5,748,206 | A * | 5/1998 | Yamane | 347/37 |
| 5,777,634 | A * | 7/1998 | Okamura et al. | 347/7 |
| 6,674,260 | B1 * | 1/2004 | Harriman et al. | 318/599 |
| 7,649,330 | B2 * | 1/2010 | Yamashita et al. | 318/560 |

FOREIGN PATENT DOCUMENTS

JP 3805155 B2 8/2006

* cited by examiner

*Primary Examiner* — Alessandro Amari
*Assistant Examiner* — Michael Konczal
(74) *Attorney, Agent, or Firm* — Canon USA Inc. IP Division

(57) ABSTRACT

A driving apparatus includes an endless belt supported by a drive pulley configured to be driven by a motor and an idler pulley, and a moving member configured to be coupled to the endless belt and moved by driving the drive pulley by the motor, wherein a first limit value of electric power to be supplied to the motor when the moving member is moved in a first direction approaching the drive pulley is set larger than a second limit value of electric power to be supplied to the motor when the moving member is moved in a second direction approaching the idler pulley.

18 Claims, 10 Drawing Sheets

DRIVING APPARATUS AND RECORDING APPARATUS

BACKGROUND OF THE INVENTION

1. Field of the Invention

The present invention relates to a driving apparatus for moving a moving member using a belt and a drive pulley.

2. Description of the Related Art

A driving apparatus for moving a moving member by a belt and a drive pulley is used in a mechanism for moving a carriage of a recording apparatus. The driving apparatus is described below using a recording apparatus as an example.

In the recording apparatus using an ink jet recording method, a carriage with a recording head mounted thereon scans over a recording material and, concurrently with the scanning operation, the recording head is driven to perform a recording operation. To obtain a high definition output image with the above-described ink jet recording apparatus, many recording apparatuses employ a direct current (DC) motor as a drive source for driving the carriage and further employ a servo control for feeding back position detection information to the recording apparatus by a linear encoder. Such a configuration can realize highly-precise position control and a high-speed stable scanning operation. In addition a method is used in which driving of the recording head is controlled according to a detection timing of the linear encoder and a timing between the scanning operation of the carriage and the driving of the recording head can be precisely adjusted.

A toothed (timing) belt excellent in a cost-effectiveness, easy assembly, an d precision, is used as a mechanism for conveying a scanning/driving force to the carriage from the direct-current (DC) motor functioning as a drive source. The toothed (timing) belt is stretched between a drive pulley driven by the DC motor and an idler pulley with a predetermined tensile force and teeth notched around the drive pulley mesh with teeth provided on the toothed belt, and the driving force is transmitted. The carriage with a recording head mounted thereon is coupled with the toothed belt to reciprocate between both pulleys according to rotation of the DC motor.

The carriage performs an abutment operation against a housing, such as a chassis, for the purposes of initialization of a position in a scanning direction and a relative movement of a mechanism unit provided within the carriage. At this time, the abutment operation may be executed by pulling the carriage in a direction approaching to the idler pulley by the toothed belt. However, the idler pulley is suspended via a tension spring, so that the idler pulley is slightly moved by being pulled toward to a side of the drive pulley at a moment when the carriage abuts against the chassis and stops. During the abutment operation of the carriage, the drive pulley keeps rotating by the DC motor. Therefore, the toothed belt is warped between the carriage due to an excessive portion of the toothed belt resulting from decrease of a distance between the idler pulley and the drive pulley. Since the drive pulley further keeps rotating, idling of the drive pulley occurs with respect to the toothed belt.

In a case where the carriage is left for a long time without performing scan, a sliding friction of the carriage may become larger due to a stain of ink or the like firmly stuck on a guide for guiding the carriage. In such a case, an issue of the idling of the drive pulley also occurs similar to the abutment operation.

A configuration including a member for preventing the toothed belt from jumping (i.e., a tooth jumping) in the vicinity of the drive pulley of the toothed belt coupled with the carriage as discussed in Japanese Patent No. 3805155 is known in order to solve the above issue.

A cost and a size tend to increase in the above-described ink jet recording apparatus. Recently, in order to decrease vibration when the drive pulley meshes with the belt, a high accuracy belt with a fine tooth pitch and a low tooth height has been employed in some cases. In the above-described case, a gap between the member for preventing the jumping and a back surface of the belt is required to be narrowed as much as possible. However, friction may occur between the member and the back surface of the belt depending on an assembled condition. The vibration caused by the friction cancels out an effect of vibration reduction produced by lowering the tooth height. In addition, the belt may be damaged or broken due to the friction or the vibration.

On the other hand, to prevent the drive pulley from the idling thereof, it is effective to increase a tensile force of the toothed belt and enlarge and/or heighten the teeth of the toothed belt. However, the increase of the tensile force of the toothed belt may increase a drive load. Therefore, a large capacity motor is required to be installed, which, however, causes an increase in the cost and the size of the apparatus. In addition, a toothed belt having higher teeth may vibrate when the teeth thereof mesh with the teeth of the drive pulley. As a result thereof, a scanning speed of the carriage may become uneven.

SUMMARY OF THE INVENTION

The present invention relates to a driving apparatus which can suppress occurrence of idling of a drive pulley with respect to a belt.

According to an aspect of the present invention, a driving apparatus includes an endless belt supported by a drive pulley configured to be driven by a motor and an idler pulley, and a moving member configured to be coupled to the endless belt and moved by driving the drive pulley by the motor, wherein a first limit value of electric power to be supplied to the motor when the moving member is moved in a first direction approaching the drive pulley is set larger than a second limit value of electric power to be supplied to the motor when the moving member is moved in a second direction approaching the idler pulley.

According to the present invention, a driving apparatus which can suppress occurrence of idling of the drive pulley with respect to the belt can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Components provided with the same numbers in all the drawings attached hereto indicate the same or the corresponding components. FIGS. 1 through 10 illustrate configurations of a recording apparatus including a carriage according to exemplary embodiments of the present invention, and the recording apparatus is exemplified in an ink jet recording apparatus which ejects an ink to perform recording on a recording medium.

Figure 1:
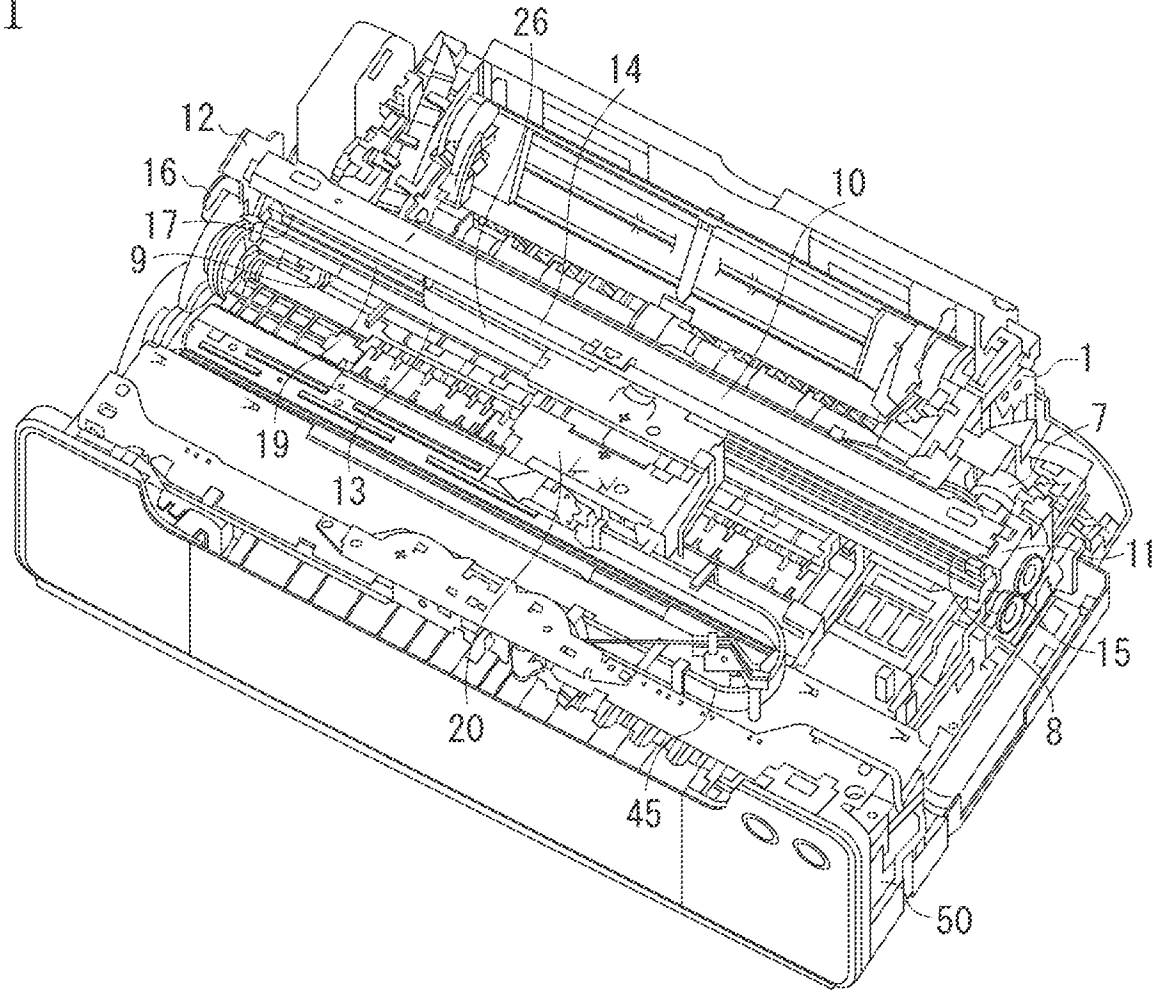
FIG. 1 is a partial perspective view illustrating an ink jet recording apparatus according to a first exemplary embodiment of the present invention.

FIG. 1 is a schematic perspective view illustrating an entire recording apparatus. The recording apparatus according to the present exemplary embodiment mainly includes a sheet feeding unit (i.e., auto sheet feed (ASF) unit), a recording medium conveyance unit (i.e., sheet conveyance unit), a sheet discharge unit, a carriage unit 20 including a recording head 30 mounted thereon, a recording head recovery unit (i.e., recovery unit), and an ink supply unit.

Recorded data is transmitted from a host device (not illustrated) and stored in a control unit 1. Then, the control unit 1 issues a recording operation start command to start a recording operation.

The carriage unit 20 mainly includes the recording head 30 serving as a recording unit and a carriage 21 on which the recording head 30 can be mounted and which configured to perform scanning (moving) in a direction crossing (normally, orthogonal to) a recording sheet conveyance direction. The recording unit may include a recording head, an ink jet head cartridge, an ink jet head, an ink jet cartridge, an ink cartridge, a pen cartridge, and the like.

The carriage 21 serving as a moving member is guided and supported by a guide shaft 13 which is supported by both side surfaces of a chassis 10 and a support rail 14 fixed to an upper section of the chassis 10. A driving force is transmitted to the carriage 21 via a carriage belt 19 stretched between a drive pulley 8 provided on a direct current (DC) motor (i.e., a carriage motor) 7 for driving the carriage 21 and an idler pulley 17, so that the carriage 21 reciprocates (i.e., scans) along the guide shaft 13.

In the above-described ink jet recording apparatus, a signal is transmitted to the recording head 30 via a flat flexible cable (FFC) 26 and ink droplets can be ejected according to recorded data. A linear scale 9 is stretched over the chassis 10 so as to be positioned along a moving path of the carriage 21. By causing a linear encoder sensor 27 mounted on the carriage unit 20 to read out a mark of the linear scale 9, an ink droplet can be ejected to a recording sheet at suitable timing.

Figure 2:
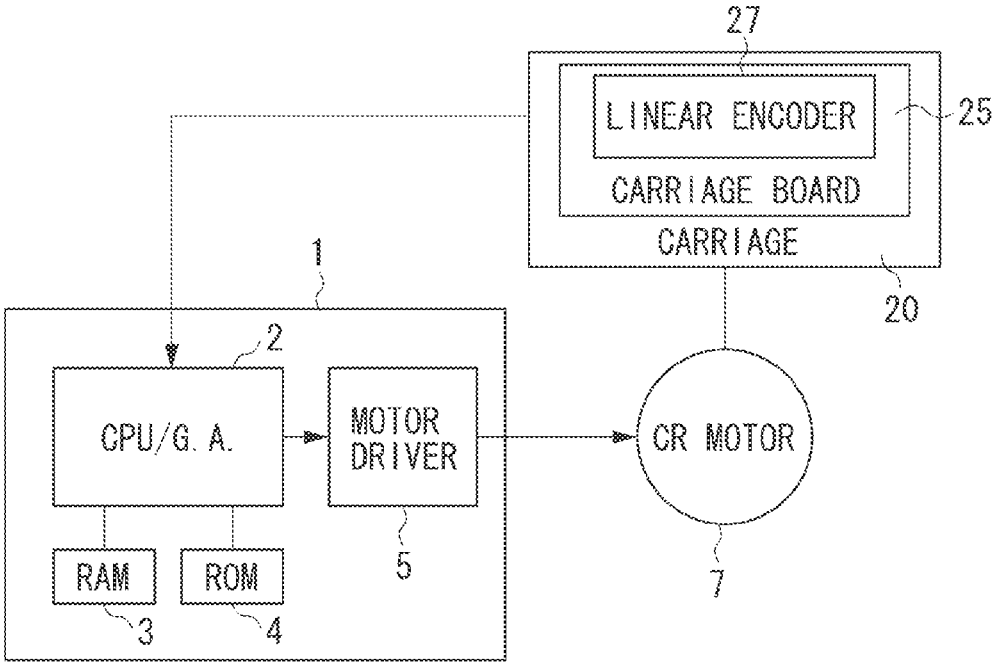
FIG. 2 is a block diagram according to a first exemplary embodiment of the present invention.

FIG. 2 is a control block diagram of the recording apparatus according to the present exemplary embodiment. A central processing unit (CPU)/gate array (G.A.) 2 is configured to control the recording apparatus. A random access memory (RAM) 3 is provided with a work area for storing parameters of a recording buffer, a receiving buffer, and a control.

A read-only memory (ROM) 4 stores programs and drive parameters of the CPU 2. The drive parameters include a motor drive pattern, a drive table of the recording head, and the like. A motor driver 5 drives a carriage (CR) motor 7. The CR motor 7 is driven according to a servo control using position information and speed information acquired from the linear encoder sensor 27. The servo control is realized by the CPU 2 executing a program stored in the ROM 4.

The ROM 4 stores information of a target speed desired to be applied to the carriage 20 for its scanning operation in the form of a driving profile (i.e., ideal velocity profile). A method referred to as a classic control or a proportional-integral-derivative (PID) control is employed as the servo control in the present exemplary embodiment in which processing is performed per an area of each of an acceleration control, a constant speed control, and a deceleration control. The driving profile includes the information of the target speed to be driven by the CR motor 7 and the target position in each area. A plurality of driving profiles according to a purpose of the carriage scan is stored in the ROM 4.

The CPU 2 selects a driving profile according to the purpose of the carriage scan among the plurality of driving profiles and executes the selected profile according to a program, thereby performing a follow-up control. In other words, The CPU 2 compares the position information and the speed information actually acquired from an output signal of the linear encoder sensor 27 with target position information and target speed information included in the selected driving profile at the time, and calculates an energy to be applied to the CR motor 7 at the time considering a difference between the information pieces as an error. In response to the above, the motor driver 5 outputs a duty ratio (i.e., ratio between a high level and a low level, ratio between on and off) according to the pulse-width modulation (PWM) control in the form of a PWM signal as the energy to be applied to the CR motor 7 to perform the servo control of the carriage 20.

The above-described servo control processing is repeated per a servo cycle $\Delta T$. A range of the duty ratio is between 0% and 100%. As the duty ratio becomes larger, an electric power to be supplied to the motor becomes larger. A plurality of upper limit values (i.e., PWM limit values) of the duty ratio can be set per motor driving with respect to the actually output PWM values. According to the present exemplary embodiment, only a suitable driving force can be generated by selecting the PWM limit value, as required, per each driving of the CR motor 7.

The servo control method itself is not a main component of the present invention, so that a different method may be employed according to the characteristics of a system to be controlled.

Figure 3:
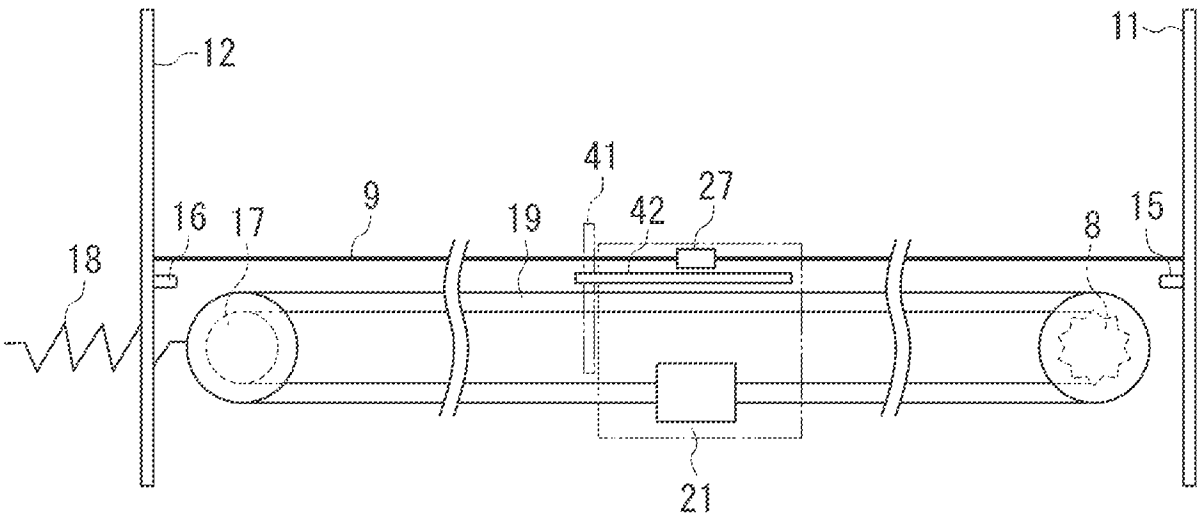
FIG. 3 is a schematic view illustrating a driving mechanism including a toothed belt stretched between a drive pulley and an idler pulley according to the first exemplary embodiment of the present invention.

FIG. 3 is a schematic cross sectional view illustrating a driving mechanism including a toothed belt 19 which serves as an endless belt stretched between a drive pulley 8 and an idler pulley 17 illustrated in FIG. 1. Although it is not illustrated in FIG. 3, teeth are provided on an inner circumferential surface of the toothed belt 19 at a predetermined pitch, and the teeth mesh with teeth provided on an outer circumference of the drive pulley 8. In FIG. 3, a supporting shaft of the idler pulley 17 is suspended to a chassis (not illustrated) via a tension spring 18. More specifically, a tensile force is applied to the toothed belt 19 by pulling the idler pulley 17 to the left in FIG. 3 by an elastic force of the tension spring 18.

The carriage 21 is mounted on a traveling portion of a lower side of the toothed belt 19 as illustrated in FIG. 3. Therefore, when the drive pulley 8 is driven in a counterclockwise direction in FIG. 3, the carriage 21 moves in a first direction, i.e., in a direction the carriage 21 approaches the drive pulley 8, such that the carriage 21 is directly pulled by the toothed belt 19. On the other hand, when the drive pulley 8 rotates in a clockwise direction, the carriage 21 moves in a second direction, i.e., in a direction the carriage 21 approaches the idler pulley 17, such that the carriage 21 is pulled by the toothed belt 19 via the idler pulley 17.

However, as described above, the idler pulley 17 is rotatably supported via the tension spring 18. Therefore, when the drive pulley 8 rotates in the clockwise direction, if the carriage 21 is in an unmovable state, the idler pulley 17 is pulled toward the drive pulley 8 to be slightly moved. The state that the carriage 21 is unmovable occurs, for example, when the carriage 21 performs an abutment operation against a side board of the chassis 10. In addition, there is a case where the carriage 21 becomes unmovable immediately after the CR motor 7 starts rotating due to a sliding load generated between the carriage 21 and the guide shaft 13 or a support rail 14. If the carriage 21 is remained still for relatively long time, mist adhered on the guide shaft 13 and the support rail 14 may firmly fix thereon and generate a large sliding load between the carriage 21 and the guide shaft 13 or the support rail 14.

If the drive pulley 8 is driven while the carriage 21 is remained still, the drive pulley 8 rotates with the movement of the idler pulley 17, and a distance between the idler pulley 17 and the drive pulley 8 decreases. Then, the excessive toothed belt 19 may slacken and be sent out to a downside of the drive pulley 8. Thus, the toothed belt 19 is warped between the downside of the drive pulley 8 and the stopped carriage 21.

In this case, since the toothed belt 19 has uniform rigidity to some extent, the toothed belt 19 would not be partially warped between the drive pulley 8 and the carriage 21 but would behave to rise from the drive pulley 8 in the vicinity of the drive pulley 8. At this time, the drive pulley 8 keeps rotating, so that the drive pulley 8 idles with respect to the toothed belt 19.

Figure 4A:
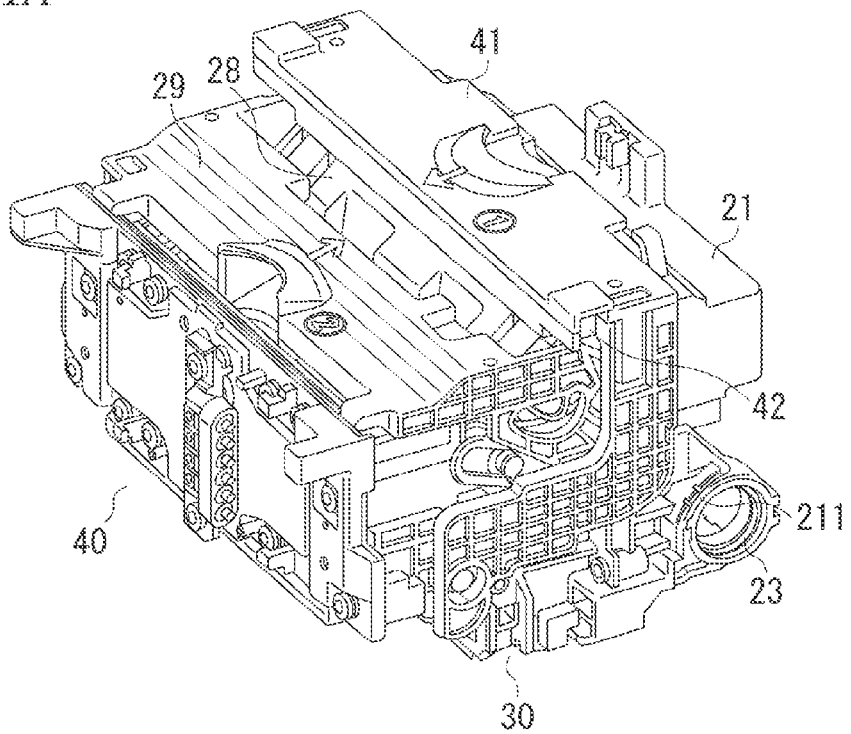
FIGS. 4A and 4B are schematic perspective views illustrating a mounted state of a recording head on a carriage unit according to the first exemplary embodiment of the present invention, respectively.
Figure 4B:
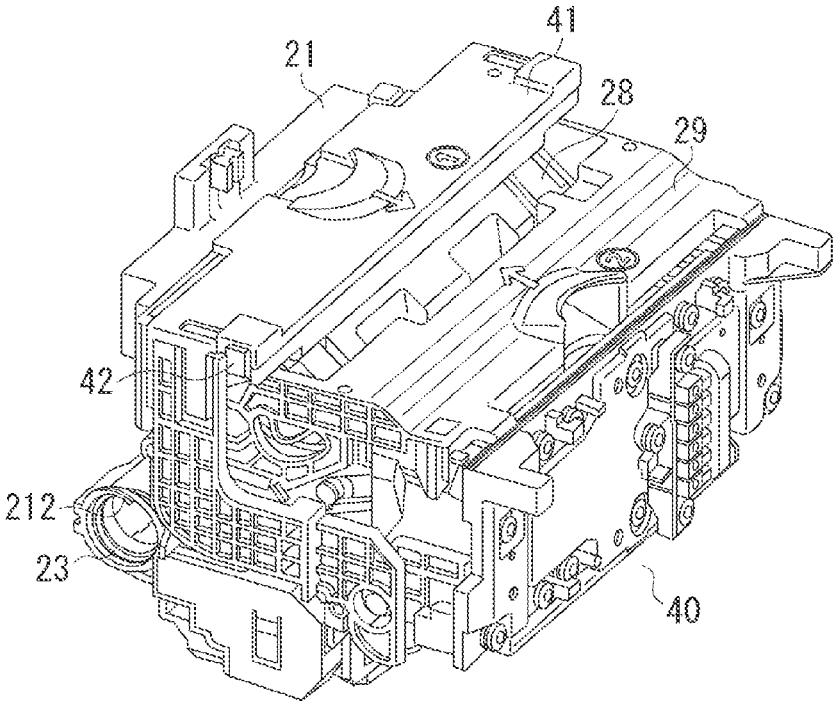

FIGS. 4A and 4B schematically illustrate a configuration of the carriage unit 20 with a recording head 30 mounted thereon. The carriage unit 20 includes the carriage 21 configured to accommodate and position the recording head 30 therein, a carriage cover 22 for guiding the recording head 30 to be mounted on the carriage 21, and a head set lever 29 for causing a head fixing unit 28 to operate. The head set lever 29 serving as an operation lever is configured to be rotatable around a rotation shaft provided on the carriage 21. Therefore, the head fixing unit 28 can be operated in response to opening and closing of the head set lever 29.

The carriage unit 20 for accommodating the recording head 30 is provided with a press-contact connector (not illustrated) for establishing an electrical connection between the carriage unit 20 and the recording head 30. The press-contact connector (not illustrated) is soldered on a carriage board (not illustrated) mounted on the carriage 21. The carriage board is electrically connected to a circuit board (i.e., control circuit) 1 on the apparatus main body via a flexible flat cable (FFC) 26 in FIG. 1. The carriage board 25 is provided with the linear encoder sensor 27 for detecting a position of the carriage unit 20. The linear encoder sensor 27 reads out the number of lines of a linear scale 9 attached to the chassis 10, and can detect the position of the carriage unit 20. A signal of the linear scale 9 is transmitted to the control circuit board 1 via the flexible flat cable 26 to be processed therein. Accordingly, the position of the carriage unit 20 can be detected accurately even while the carriage unit 20 is moving.

If a signal of the linear encoder sensor 27 does not change when the CR motor 7 is driven for a certain time period, the carriage 21 is considered to be stable at the position. Therefore, the lastly detected position can be detected as a stop position. In the recording apparatus according to the present exemplary embodiment, upon initialization of the scanning position of the carriage 21, the carriage 21 is moved to scan toward a right side board 11 as a first abutment portion of the chassis 10 and a position at which the carriage 21 abuts against the right side board 11 to stop moving thereat is considered as a scan reference position. The carriage 21 is provided with an abutment reference surface 211 which abuts against an inner side surface of the right side board 11 of the chassis 10.

The recording head 30 mounted on the carriage unit 20 is connected to an ink supply tube 45 made of a flexible tube for establishing an ink flow path via a joint mechanism 40. The ink supply tube 45 is arranged to follow the carriage unit 20 all over the scanning area thereof and connected to an ink supply unit 50.

The joint mechanism 40 is provided with a joint lever 41 with an operation unit such that the joint lever 41 is rotatably supported centering around a lever rotation shaft (not illustrated). By rotating the joint lever 41 at a predetermined position, the joint mechanism 40 switches between connection and disconnection of the ink flow path with the recording head 30. The joint lever 41 is provided with a slider member 42 for selectively locking an opening/closing operation by a user when the joint lever 41 is closed. The slider member 42 is configured to slide relative to the carriage 21 in a main scanning direction by abutting both end portions thereof against a reference side switching member 15 and non-reference side switching member 16 provided on both chassis side boards, respectively.

According to the present exemplary embodiment, while the carriage 21 abuts against the reference side, a right end of the slider member 42 abuts against the reference side switching member 15 provided on the right side board 11 of a right side of the chassis 10 to move to the first position. In this state, the joint lever 41 is locked, and thus an operator cannot open the joint lever 41 despite of the operator's attempt to do so. When the carriage 21 abuts against the left side board 12 as a second abutment portion, a left end of the slider member 42 abuts against the non-reference side switching member 16 provided on the left side board 12 to cause the slider member 42 to relatively move to a second position with respect to the carriage 21. At this time, the joint lever 41 is unlocked to allow the operator to open the joint lever 41.

As described above, the abutment operation of the carriage unit 20 against the left side board 12 and the right side board 11 of the chassis 10 enables the joint lever 41 to switch between an openable state and a closable state.

The operation to abut the carriage 21 against the inner side surface of the right side board 11 in order to initialize the position information of the carriage 21 read out by the linear encoder sensor 27 is described below.

Upon issuance of a right abutment command, a right side abutment drive table and a first PWM limit value (i.e., first limit value of the duty ratio) are selected in order to perform a right side abutment operation for moving the carriage 21 in the right direction. In the above-described operation, the carriage 21 is moved to a direction approaching to the drive pulley 8 in which less tooth jumping occurs, so that the first PWM limit value is a relatively large value. The first PWM limit value of the present exemplary embodiment has a duty ratio of, for example, 90%. The first PWM limit value is not only limited to the above value but also may be a value smaller than 90% for the purpose of decreasing a noise generated at the time of the abutment operation.

After selecting the right abutment drive table and the first PWM limit value (i.e., the first limit value of the duty ratio), the CR motor 7 is driven to cause the carriage 21 to abut against the inner side surface of the right side board 11. At this time, the power supply to the CR motor 7 is controlled such that the duty ratio thereof becomes equal to or less than the first limit value according to the PWM control. In other words, the maximum electric power supplied to the CR motor 7 is controlled so as to be equal to or less than a first electric power of which duty ratio is equal to or less than the first limit value. When it is determined that the output signal output from the linear encoder sensor 27 no longer varies and the carriage 21 is stopped, the right abutment operation is completed. A position of the carriage 21 at this time is determined as an original position and, hereinafter, the original position is referred to when specifying the position of the carriage 21 based on the output signal from the linear encoder sensor 27.

Figure 5:
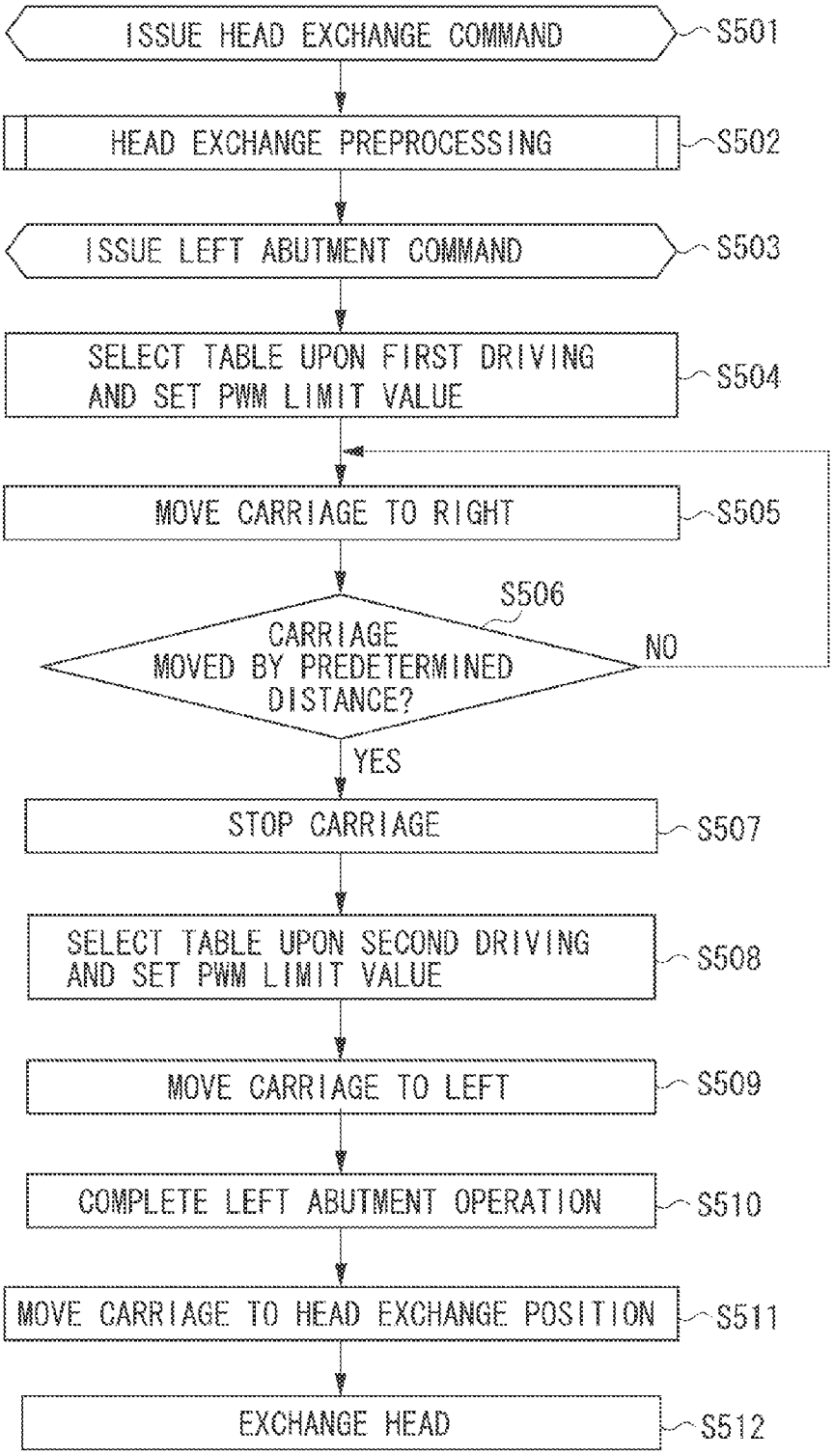
FIG. 5 is a flow chart illustrating recording head exchange processing performed in a recording head exchange mode according to the first exemplary embodiment of the present invention.

FIG. 5 is a flow chart schematically illustrating head exchange processing performed in a recording head exchange mode. In step S501, the operator performs a predetermined operation to shift the ink jet recording apparatus to the recording head exchange mode. According to the present exemplary embodiment, a control unit of the ink jet recording apparatus causes the ink jet recording apparatus to be shifted to the recording head exchange mode by pressing a reset button (not illustrated) for a predetermined period of time or more (e.g., three seconds). Alternatively, the control unit may shift the ink jet recording apparatus to the recording head exchange mode using an interface provided on a printer driver.

In step S502, when the ink jet recording apparatus is shifted to the recording head exchange mode, exchange preprocessing of the recording head is started. When the exchange preprocessing of the recording head is completed, in step S503, a command for executing the left abutment operation is issued to unlock the joint lever 41.

In step S504, the first drive table for performing the first driving to move the carriage 21 and a third PWM limit value (i.e., a third limit value of the duty ratio) are selected. More specifically, the maximum electric power to be supplied to the CR motor 7 is controlled to a value equal to or less than a third electric power of which duty ratio is equal to or less than the third limit value. At this time, if the recording apparatus is not used for a certain period of time immediately before the above-described processing, a bearing portion 23 serving as a sliding unit of the carriage 21 may be firmly stuck between the bearing portion 23 and the guide shaft 13 due to the ink mist and the like. In such a case, a scanning load may be remarkably large. Therefore, in the first driving, a limit value of a relatively large duty ratio such as 90% is set to the PWM limit value (i.e., limit value of the duty ratio) as the third PWM limit value.

In step S505, the servo control for driving the CR motor 7 is executed, and the CR motor 7 is driven in a counterclockwise direction in FIG. 3 to cause the carriage 21 to move toward a side of the CR motor 7 for a predetermined distance. At this time, the electric power supplied to the CR motor 7 is controlled such that the duty ratio becomes a value equal to or less than the third limit value.

If the bearing portion 23 of the carriage 21 is firmly stuck to the guide shaft 13 due to a mist and the like, since the limit value of the duty ratio is set to a large value, the electric power can be supplied to the CR motor 7 at a high duty ratio. Therefore, a driving force enough for the carriage 21 to be free from the stuck state to move can be generated. At this time, the carriage 21 is driven to the side of the CR motor 7 and does not cause the movement of the idler pulley 17. Therefore, the jumping phenomenon of the toothed belt would not occur. In step S506, if it is determined that the carriage 21 is moved by a predetermined distance (YES in step S506), then in step S507, the carriage 21 is stopped for a while.

Figure 6:
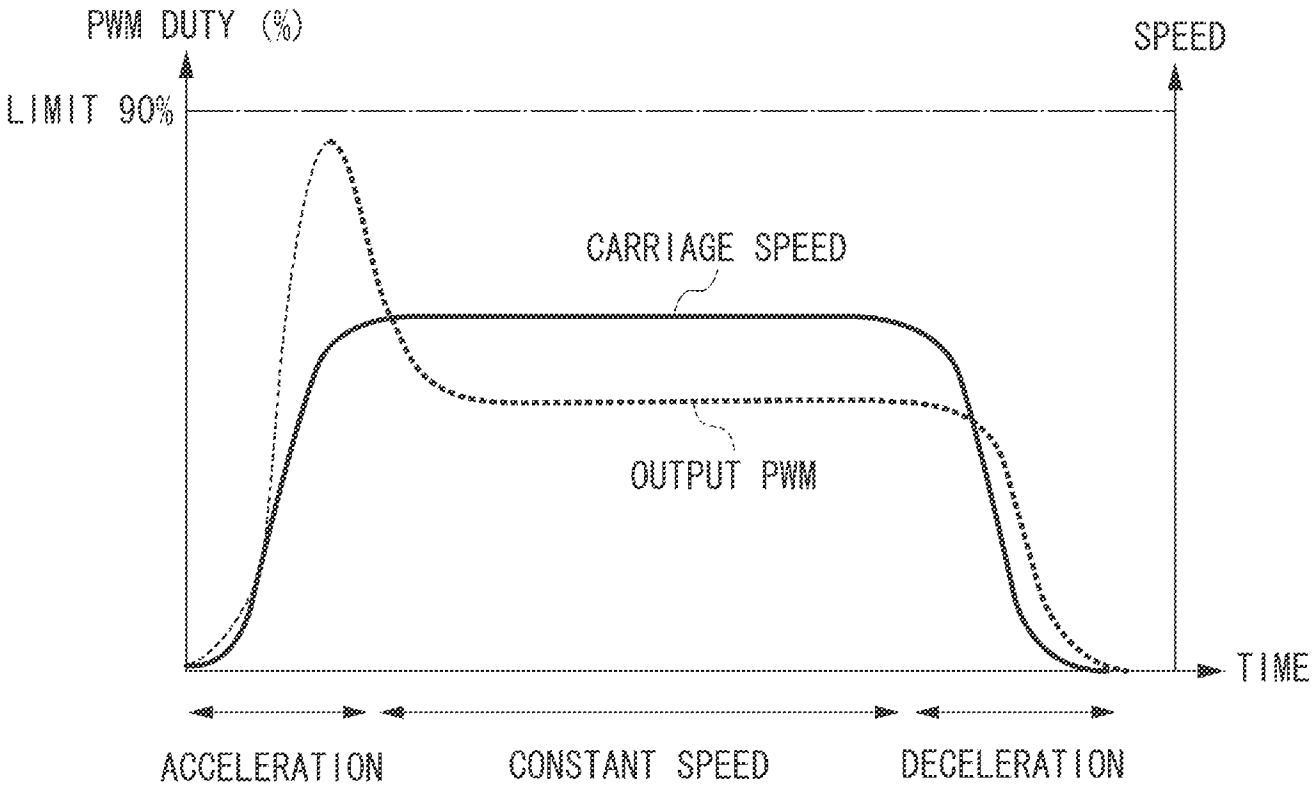
FIG. 6 is a schematic view illustrating a first driving operation according to the first exemplary embodiment of the present invention.

FIG. 6 is a schematic view illustrating the PWM value output by driving the CR motor 7 and the carriage speed at the time, which are graphed per time each value is acquired, according to the processing in steps S505 through S507. As described above, according to the present exemplary embodiment, a large PWM value is required to be output from a start of the movement of the carriage 21 in the first driving to a period during which the movement of the carriage 21 is accelerated. Consequently, the PWM limit value is required to be set such that an enough electric power (PWM) for allowing the carriage 21 to move in the first driving can be output.

In step S508, a second drive table for executing a second driving for causing the carriage 21 to perform the left abutment operation and a second PWM limit value (i.e., second limit value of the duty ratio) are selected. In other words, the maximum electric power to be supplied to the CR motor 7 is controlled to a value equal to or less than a second electric power of which duty ratio is equal to or less than a second limit value. At this time, the second limit value of the duty ratio is set to a relatively small limit value, e.g., 30%, to an extent that the tooth jumping does not occur even at a moment when the carriage 21 performs the left abutment operation. In other words, the second electric power is smaller than the first electric power. The second electric power is further smaller than a third electric power.

In step S509, the servo control for driving the CR motor 7 is executed to cause the CR motor 7 to drive in a clockwise direction in FIG. 3. At this time, the CR motor 7 is subjected to the PWM control so that the duty ratio becomes a value equal to or less than the second limit value. The carriage 21 is moved to the side of the idler pulley 17 until it is determined that the carriage 21 abuts against the idler pulley 17. In step S510, when it is determined that the carriage 21 abuts against the idler pulley 17 and stops, the lastly detected position is determined as an abutment stop position and the abutment operation is completed.

Figure 7:
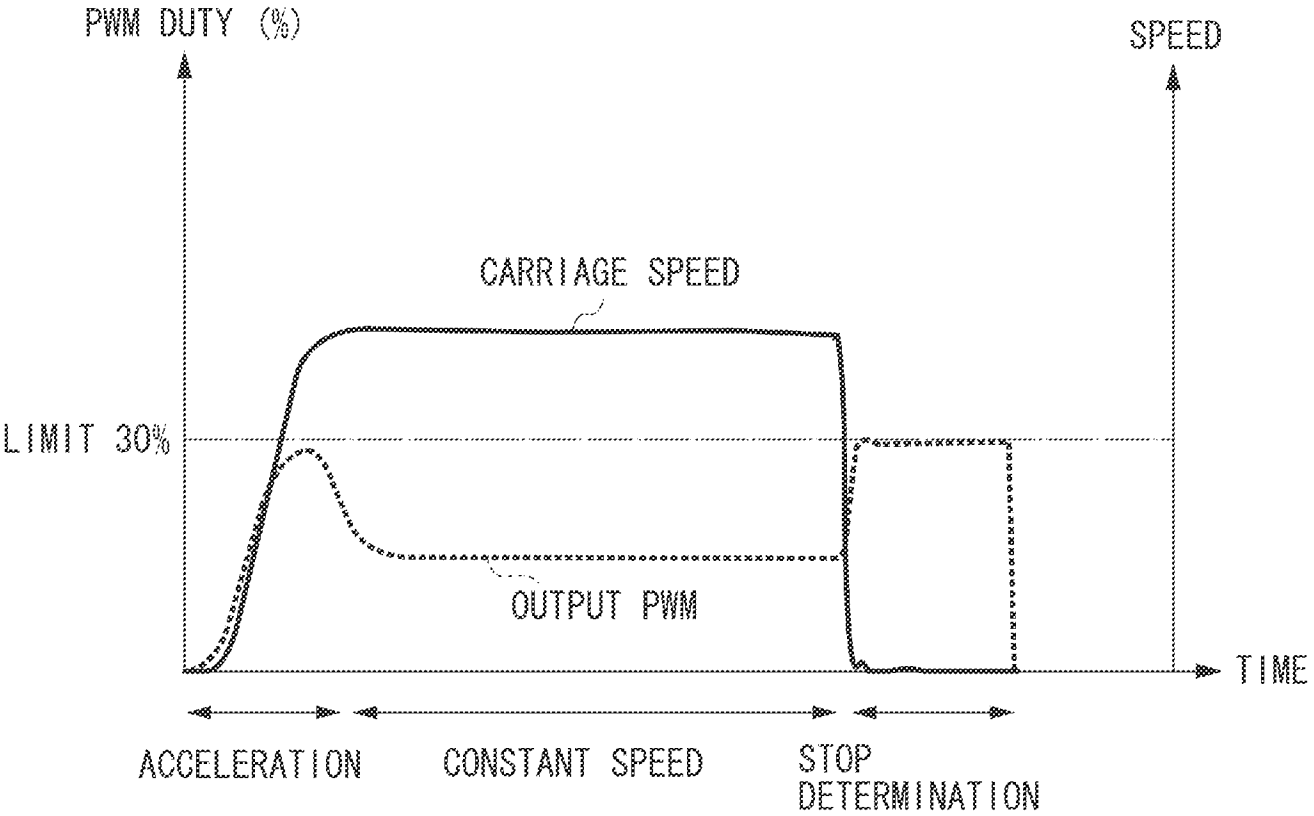
FIG. 7 is a schematic view illustrating a second driving operation according to the first exemplary embodiment of the present invention.

FIG. 7 is a schematic diagram illustrating the PWM value output by driving the CR motor 7 and the carriage speed at the time, which are graphed per time each value is acquired, according to the processing in steps S509 through S510.

As described above, in the second driving, the carriage 21 can move with a relatively small duty ratio from the start of movement of the carriage 21 to a period during which the carriage 21 is accelerated. This is because, the carriage 21 has started to move from the state that the bearing portion 23 of the carriage 21 is firmly stuck by the lastly performed first driving. In addition, since the carriage 21 moves back, the carriage 21 moves again over the shaft 13 in a state that mist and the like on its surface is dispersed by the passage of the carriage 21. Therefore, at a time of the second driving, the carriage 21 can start to move with a relatively low limit value as illustrated in FIG. 7.

Therefore, in the subsequent determination as to whether the carriage is stopped in the abutment state, the limit value of the duty ratio can be set to a relatively low value for the purpose of lowering the driving force generated by the CR motor 7. According to the present exemplary embodiment, in view of the PWM value required in the acceleration of the second driving and the PWM value which would not cause the idling of the drive pulley 8 while the stop state determination processing, the second limit value of the duty ratio is set to 30%.

As illustrated in FIG. 7, at a moment of the abutment of the carriage 21, a signal of the linear encoder sensor 27 does not change for a certain period of time if the CR motor 7 is driven. In other words, a state that the speed of the carriage 21 is not detected continues. In this case, it is determined that the carriage 21 stays at the position and thus the lastly detected position is detected as the stop position.

According to the present exemplary embodiment, by setting the limit value of the duty ratio to 30%, if the carriage 21 is stopped, a force that the idler pulley 17 is pulled to the side of the drive pulley 8 is limited. Therefore, during the above-described state, if the drive pulley 8 is driven continuously, decrease of the distance between the idler pulley 17 and the drive pulley 8 is controlled, and the jumping phenomenon (i.e., tooth jumping phenomenon) such as idling of the drive pulley 8 with respect to the toothed belt 19 can be prevented from occurring. As described above, the second limit value of the duty ratio at the time of the left abutment operation of the carriage 21, in which the idling of the drive pulley 8 tends to occur more than the right abutment operation, is smaller than the first limit value of the duty ratio at the time of the right abutment operation of the carriage 21.

As described above, when the carriage 21 is subjected to left abutment operation, an abutment non-reference surface 212 provided on the carriage 21 abuts against the inner side of the left side board 12 of the chassis 10, and the carriage 21 is stopped thereat. At this time, the left end of the slider member 42 provided in the joint lever 41 abuts against the non-reference side switching member 16 provided on the left side board 12 to relatively move in a right direction within the joint lever 41 to a second position. In the present configuration, the carriage 21 moves about 4 mm after the left end of the slider member 42 abuts against the non-reference side switching member 16, and the carriage 21 abuts against the inner surface of the left side board 12 of the chassis 10 to stop thereat. Thus, the slider member 42 within the joint lever 41 also relatively slides about 4 mm in a right direction.

As described above, the slider member 42 is positioned at the second position and a regulation of the joint lever 41 is released by the non-reference side abutment operation of the carriage unit 20. Then, in step S511, the carriage unit 20 is moved again to a head exchange position as about a middle section of the movable range of the carriage unit 20 as illustrated in FIG. 1. In step S512, the operator can exchange the recording head after the series of the above-described operations end.

Figure 8:
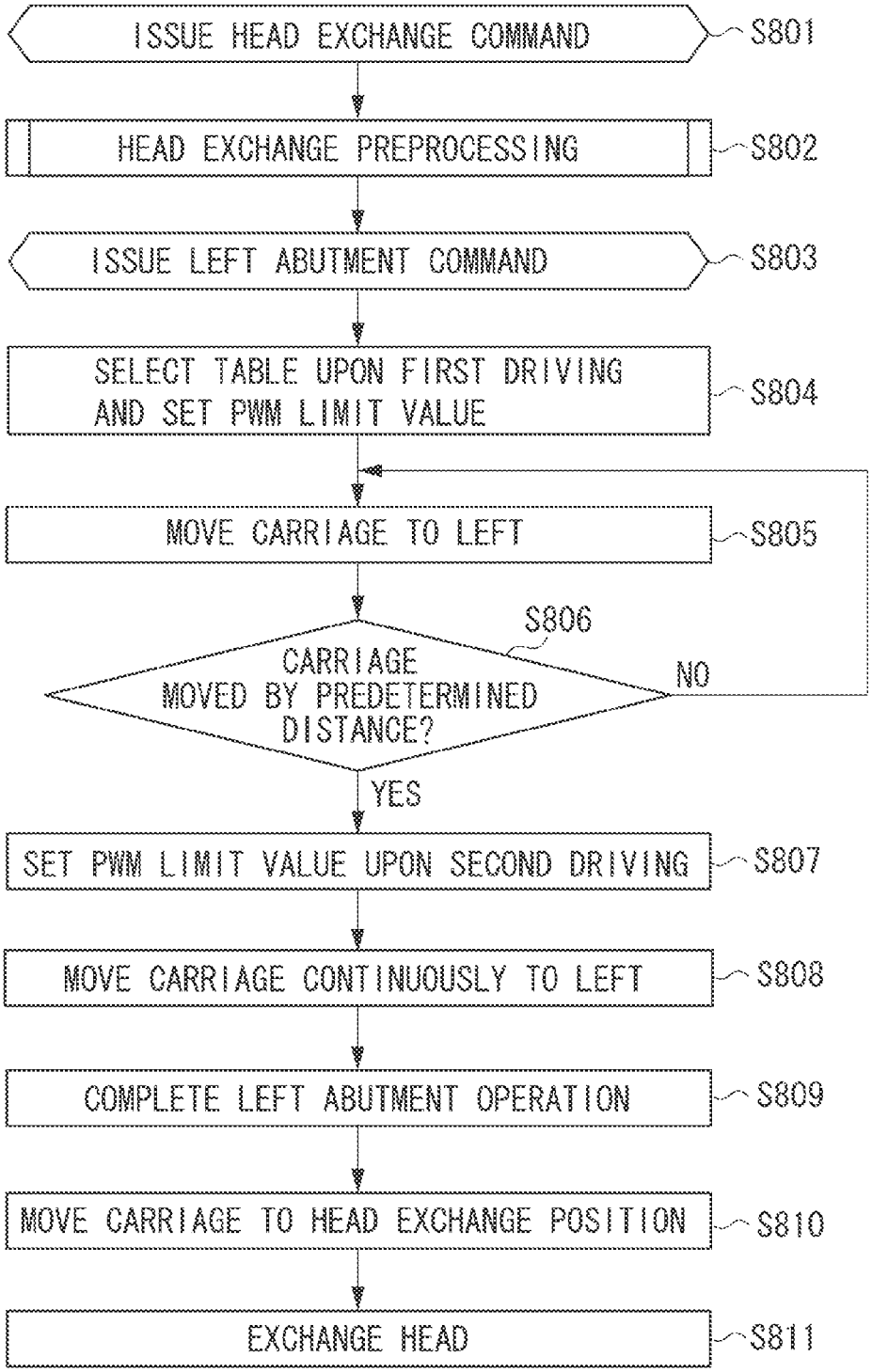
FIG. 8 is a flow chart illustrating recording head exchange processing in a recording head exchange mode according to a second exemplary embodiment of the present invention.

FIG. 8 is a flow chart schematically illustrating head exchange processing in a recording head exchange mode according to a second exemplary embodiment of the present invention.

In step S801, similar to the first exemplary embodiment, the operator performs a predetermined operation to shift the ink jet recording apparatus to the recording head exchange mode. In step S802, when the ink jet recording apparatus is shifted to the recording head exchange mode, the exchange preprocessing of the recording head is started. When the exchange preprocessing of the recording head ends, in step S803, a command for executing the left side abutment operation for releasing the lock of the joint lever 41 is issued.

In step S804, a drive table for executing the first driving for moving the carriage 21 to a direction approaching to the idler pulley 17 and a third limit value of the duty ratio are selected. At this time, the third limit value of the duty ratio in the first driving is set to a relatively large limit value, e.g., 90%, such that the third limit value exceeds in a scanning load at the time the carriage 21 starts moving.

In step S805, the servo control for driving the CR motor 7 is executed to drive the CR motor 7 in the clockwise direction in FIG. 3, and the carriage 21 is moved to the side of the idler pulley 17 by a predetermined distance. If the bearing portion 23 of the carriage 21 is firmly stuck to the guide shaft 13 due to mist and the like, since the limit value of the duty ratio is set to a large value, the carriage 21 can move by tearing itself the stuck.

In step S806, if it is determined that the carriage 21 is moved by a predetermined distance (YES in step S806), then in step S807, a second PWM limit value for allowing the carriage 21 to execute the abutment operation is selected. At this time, while the carriage 21 is continuously driven without stopping, only the setting of the limit value of the duty ratio is changed. More specifically, the driving profile of the CR motor 7 is remained as a profile identical to the profile of the first driving. The second limit value of the duty ratio of the second driving is set to a relatively small limit value, e.g., 30%, such that the tooth jumping action would not occur even at a moment when the carriage 21 performs the abutment operation.

In step S808, while the servo control for driving the CR motor 7 is executed, the carriage 21 becomes the second drive state in which only the limit value of the duty ratio is changed. Therefore, the carriage 21 continuously moves to the side of the idler pulley 17 until it is determined that the carriage 21 abuts against the idler pulley 17. In step S809, if it is determined that the carriage 21 abuts against the idler pulley 17 and stops thereat, the lastly detected position is detected as an abutment stop position and thus the abutment operation of the carriage 21 is completed.

Figure 9:
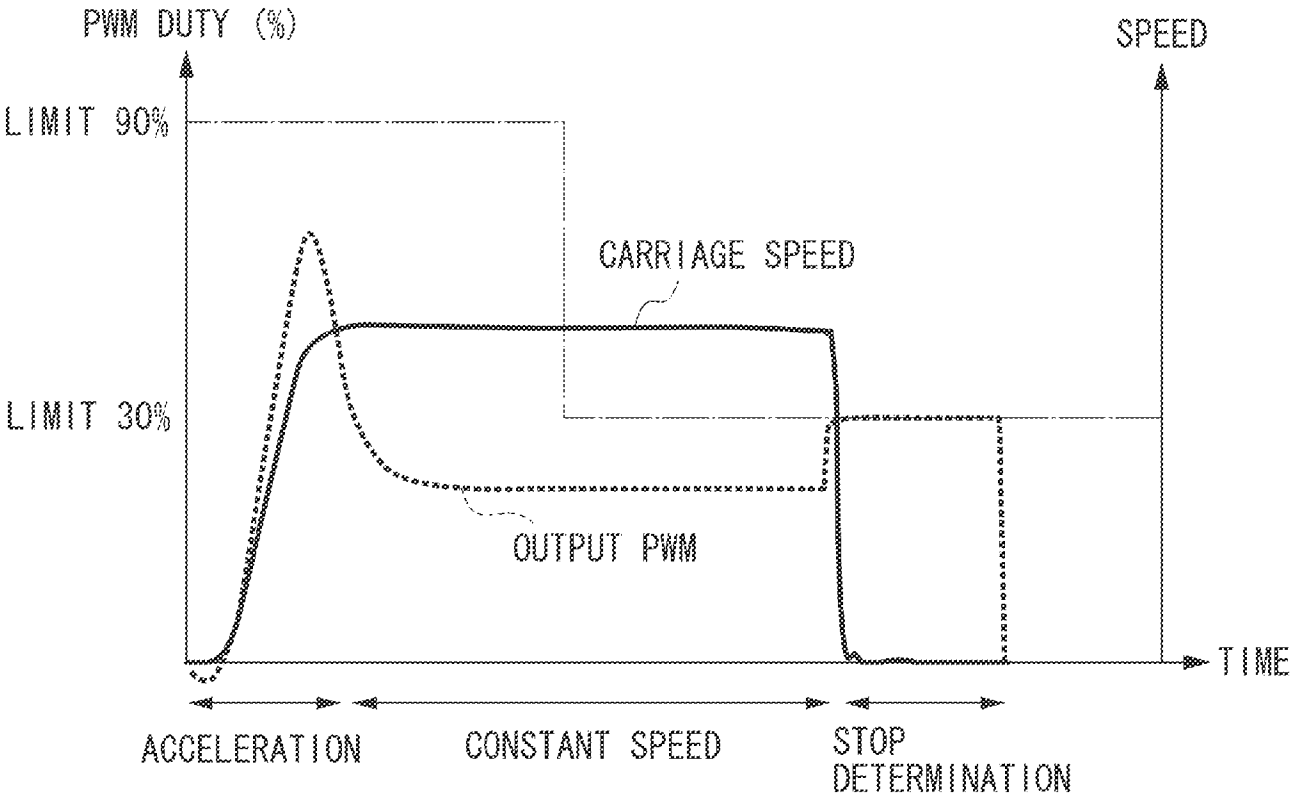
FIG. 9 is a schematic view illustrating an operation of driving according to the second exemplary embodiment of the present invention.

FIG. 9 is a schematic view illustrating the PWM value output by a continuous CR motor drive and the carriage speed at the time, which are graphed per time each value is acquired, according to the processing in steps S805 through S809. As described above, owing to the third limit value of the duty ratio, the carriage 21 can start to move because the electric power having a high duty ratio is output to the CR motor 7 when the carriage 21 having a heavy load starts moving. In addition, the continuous movement of the carriage 21 without stopping makes the carriage 21 free from an effect of static friction or the like.

Therefore, at the time of the second driving, the carriage 21 can keep moving even with a power supply within a range of the second limit value of a relatively low duty ratio. Thus, in the subsequent abutment state, the second limit value of the relatively low duty ratio can be set for the purpose of decreasing the driving force generated by the CR motor 7 in the stop determination processing. According to the present exemplary embodiment, the drive load upon the second driving is small and the second limit value of the duty ratio is set to 30% in order to prevent the drive pulley 8 from idling during the stop determination processing.

Accordingly, regulation of the joint lever 41 can be released by the non-reference side abutment operation of the carriage unit 20, as in the case of the first exemplary embodiment. Then, in step S810, the carriage unit 20 is moved again to the head exchange position lying about a middle of the movable range of the carriage unit 20 as illustrated in FIG. 1. In step S812, the operator can exchange the recording head after the series of the above-described operations end.

According to the second exemplary embodiment, when the carriage 21 is performs the right abutment operation, the right abutment drive table and the first PWM limit value (i.e., first limit value of the duty ratio) are selected. The first limit value of the duty ratio is larger than the second limit value of the duty ratio at the time of the left abutment operation.

Figure 10:
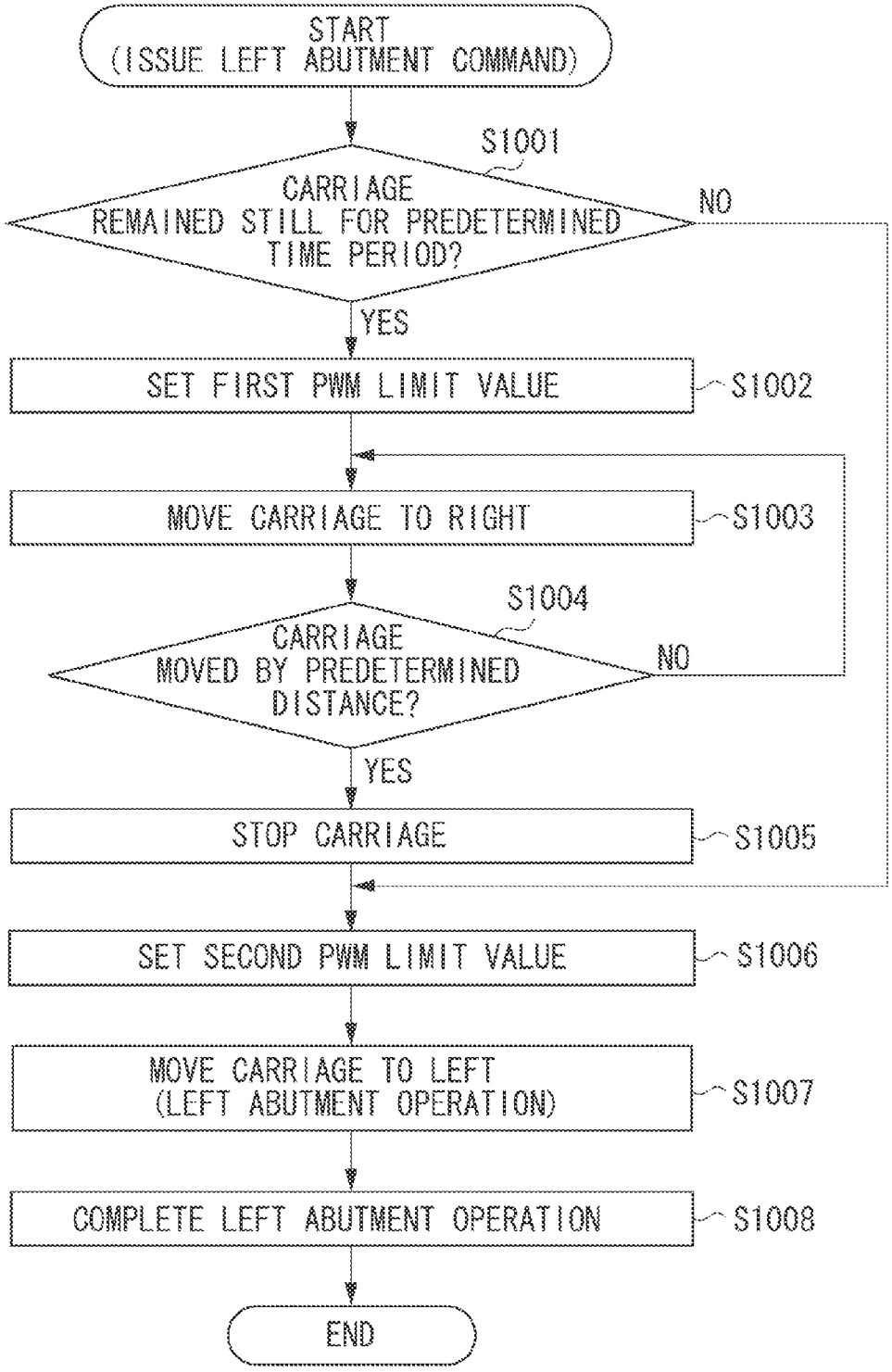
FIG. 10 is a flow chart illustrating recording head exchange processing in a recording head exchange mode according to a third exemplary embodiment of the present invention.

FIG. 10 is a flowchart according to a third exemplary embodiment. A mechanical configuration and a configuration of a control circuit according to the third exemplary embodiment are similar to those of the first exemplary embodiment.

Similar to the first exemplary embodiment, when the left abutment command is issued at the time of exchanging of the recording head, in step S1001, it is determined whether the time lapsed after the CR motor 7 is driven lastly is more than a predetermined period of time. This is for the purpose of determining whether the carriage 21 is remained still for a period of time to the extent that the carriage 21 is stuck with the guide shaft 13 by the mist (e.g., from several tens of hours to several hundreds of hours).

If it is determined that more than the predetermined period of time has elapsed from the last driving of the carriage 21 (YES in step S1001), the processing proceeds to step S1002. In step S1002, the PWM limit value is set to 90% as a third PWM limit value (i.e., third limit value of the duty ratio). In step S1003, the carriage 21 is moved in the right direction in which the tooth jumping hardly occurs.

In step S1004, if the carriage 21 is moved in the right direction by a predetermined distance (YES in step S1004), in step S1005, the carriage is stopped. Then in step S1006, the PWM limit value is set to 30% as the second PWM limit value (i.e., second limit value of the duty ratio). In step S1007, the carriage 21 is moved in the left direction and, when the signal of the linear encoder sensor 27 does not change any more, in step S1008, it is determined that the carriage 21 abuts against the left side board 12 and stops thereat. Then, the abutment operation is completed.

In step S1001, if the time passed after the CR motor 7 was driven last time is shorter than a predetermined period of time (NO in step S1001), since no stuck of the carriage 21 has occurred, the processing proceeds to step S1006. In step S1006, the duty ratio is set to the second limit value and the following left abutment operation is controlled.

In the third exemplary embodiment, when the carriage 21 performs the right abutment operation, the first drive table and the first PWM limit value (i.e., first limit value of the duty ratio) are selected. The first limit value of the duty ratio is larger than the second limit value of the duty ratio at the time of the left abutment operation.

As described above, at the moment when the carriage 21 performs the abutment operation by moving in a direction approaching the idler pulley 17 such that the carriage 21 is pulled by the toothed belt via the idler pulley 17, a force that the CR motor 7 pulls the toothed belt 19 can be controlled. Therefore, an amount of movement of the idler pulley 17 moved by being pulled toward the drive pulley 8 is also restricted, so that the rise of the toothed belt 19 is inhibited and thus the idling of the drive pulley 8 is also inhibited. Accordingly, the ink jet recording apparatus which can prevent the jumping phenomenon of the toothed belt 19 can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-232049 filed Oct. 21, 2011, which is hereby incorporated by reference herein in its entirety.

What is claimed is:

1. A driving apparatus, comprising:

an endless belt supported by a drive pulley configured to be driven by a DC motor and an idler pulley;

a linear scale arranged along the endless belt;

a moving member configured to be coupled to the endless belt;

a sensor provided on the moving member and configured to read the linear scale; and a control unit configured to servo control the DC motor based on a reading result of the sensor;

wherein a first limit value of electric power to be supplied to the DC motor when the moving member is moved in a first direction approaching the drive pulley is set larger than a second value of electric power to be supplied to the DC motor when the moving member is moved in a second direction approaching the idler pulley.

2. The driving apparatus according to claim 1, further comprising an urging unit configured to apply a force to the idler pulley in a direction away from the drive pulley.

3. The driving apparatus according to claim 1, further comprising a control unit configured to, in a case of moving the moving member in the second direction, control the moving member to move in the first direction by a predetermined distance and then to move in the second direction.

4. The driving apparatus according to claim 3, wherein the control unit controls electric power to be supplied to the motor to be a value equal to or less than a third limit value which is larger than the second limit value in a case of moving the moving member in the first direction by a predetermined distance before moving the moving member in the second direction.

5. The driving apparatus according to claim 1, further comprising a control unit configured to control electric power to be supplied to the motor by a pulse-width modulation (PWM) control.

6. A driving apparatus, comprising:

an endless belt supported by a drive pulley configured to be driven by a DC motor and an idler pulley;

a linear scale arranged along the endless belt;

a moving member configured to be coupled to the endless belt;

a sensor provided on the moving member and configured to read the linear scale; and a control unit configured to servo control the DC motor based on a reading result of the sensor;

wherein the control unit configured to, in a case of moving the moving member in a direction approaching the idler pulley, control the moving member to move in a direction approaching the drive pulley by a predetermined distance before moving in the direction approaching the idler pulley, and then move in the direction approaching the idler pulley, wherein a limit value of electric power to be supplied to the DC motor when the moving member is moved in the direction approaching the drive pulley by the predetermined distance is set to a value larger than a limit value of electric power to be supplied to the DC motor when the moving member is moved in the direction approaching the idler pulley.

7. The driving apparatus according to claim 6, further comprising an urging unit configured to apply a force to the idler pulley in a direction away from the drive pulley.

8. The driving apparatus according to claim 7, wherein the control unit controls electric power to be supplied to the motor by a PWM control.

9. A recording apparatus, comprising:

a driving apparatus according to claim 6, wherein the moving member includes a carriage capable of mounting a recording head thereon.

10. The recording apparatus according to claim 9, further comprising an urging unit configured to apply a force to the idler pulley in a direction away from the drive pulley.

11. A recording apparatus, comprising:

a carriage configured to include a recording head mountable thereon;

an endless belt configured to be coupled to the carriage;

a drive pulley configured to be driven by a DC motor and to drive the endless belt;

a linear scale arranged along the endless belt;

a sensor provide on the carriage and configured to read the linear scale;

a first abutment portion against which the carriage abuts in a case where the carriage is moved in a direction approaching the drive pulley;

a second abutment portion against which the carriage abuts in a case where the carriage is moved in a direction away from the drive pulley; and a control unit configured to control the DC motor by a PWM control so as to cause a duty ratio to be a value equal to or less than a first limit value in a case where the carriage abuts against the first abutment portion, and to control the DC motor by the PWM control so as to cause the duty ratio to be equal to or less than a second limit value which is smaller than the first limit value in a case where the carriage abuts against the second abutment portion.

12. The recording apparatus according to claim 11, further comprising:

a linear scale arranged along a moving path of the carriage; and an encoder sensor provided on the carriage and configured to read out a mark of the linear scale, wherein a position at which the carriage abuts against the first abutment portion is an original position of the carriage for specifying a position of the carriage based on an output signal output from the encoder sensor.

13. The recording apparatus according to claim 12, wherein the carriage includes a slider member which relatively moves with respect to the carriage in a case where the carriage abuts against the second abutment portion.

14. The recording apparatus according to claim 13, wherein an operation lever is unlocked by moving the slider member with respect to the carriage.

15. The recording apparatus according to claim 14, wherein the operation lever is configured to secure a recording head to the carriage.

16. The recording apparatus according to claim 11, wherein, in a case where the carriage is caused to abut against the second abutment portion, the control unit controls the carriage to move in a direction approaching the first abutment portion and then to move in a direction approaching the second abutment portion.

17. The recording apparatus according to claim 11, wherein, in a case where the carriage is caused to abut against the second abutment portion, the control unit controls the motor by the PWM control such that a duty ratio becomes a value equal to or less than a third limit value which is larger than the second limit value in order to cause the carriage to move in a direction approaching the first abutment portion before the carriage moves in a direction approaching the second abutment portion.

18. The recording apparatus according to claim 11, wherein an idler pulley is provided separately from the drive pulley and the endless belt is stretched between the drive pulley and the idler pulley.

* * * * *